US010820111B2

(12) United States Patent
Nicoletti

(10) Patent No.: US 10,820,111 B2
(45) Date of Patent: Oct. 27, 2020

(54) ACOUSTIC MEMBRANE FOR A LOUDSPEAKER AND CORRESPONDING LOUDSPEAKER

(71) Applicant: FOCAL JMLAB, La Talaudiere (FR)

(72) Inventor: Giuliano Nicoletti, La Talaudiere (FR)

(73) Assignee: FOCAL JMLAB, La Talaudiere (FR)

( * ) Notice: Subject to any disclaimer, the term of this patent is extended or adjusted under 35 U.S.C. 154(b) by 184 days.

(21) Appl. No.: 16/061,552

(22) PCT Filed: Nov. 15, 2016

(86) PCT No.: PCT/FR2016/052962

§ 371 (c)(1),
(2) Date: Jun. 12, 2018

(87) PCT Pub. No.: WO2017/103360

PCT Pub. Date: Jun. 22, 2017

(65) Prior Publication Data

US 2020/0053474 A1 Feb. 13, 2020

(30) Foreign Application Priority Data

Dec. 14, 2015 (FR) ..... 15 62261

(51) Int. Cl.
*H04R 9/06* (2006.01)
*H04R 7/14* (2006.01)
*H04R 9/04* (2006.01)

(52) U.S. Cl.
CPC ..... *H04R 9/06* (2013.01); *H04R 7/14* (2013.01); *H04R 9/045* (2013.01)

(58) Field of Classification Search
CPC . H04R 9/06; H04R 9/00; H04R 9/045; H04R 9/046; H04R 9/047; H04R 7/14;
(Continued)

(56) References Cited

U.S. PATENT DOCUMENTS 4,590,332 A 5/1986 Delbuck
6,490,363 B1 * 12/2002 Liu ..... H04R 9/06 381/403

(Continued)

FOREIGN PATENT DOCUMENTS

EP 1618761 A2 1/2006
WO WO-2005015950 A1 2/2005

OTHER PUBLICATIONS

European Patent Office, International Search Report for Corresponding International Application No. PCT/FR2016/052962, dated Feb. 20, 2017 (2 pgs.).

*Primary Examiner* — Fan S Tsang
*Assistant Examiner* — Angelica M McKinney
(74) *Attorney, Agent, or Firm* — Harris Beach PLLC

(57) ABSTRACT

A circular acoustic membrane having an upper surface and an opposite lower surface, said membrane being intended to be coupled, at the lower surface thereof, to a mobile winding via a support. The membrane has an annular fold concentrically delimiting, in the membrane, a circular central portion and an annular peripheral portion. In addition, the central portion has a concavity turned towards the upper surface and the internal edge of the fold is carried by the lower surface and comprises an attachment surface intended for the coupling of said support of the coil.

16 Claims, 2 Drawing Sheets

(58) Field of Classification Search
CPC ... H04R 7/16; H04R 7/18; H04R 7/20; H04R 7/22; H04R 7/24
See application file for complete search history.

(56) References Cited

U.S. PATENT DOCUMENTS

| | | | | |
|---|---|---|---|---|
| 10,694,279 | B1 * | 6/2020 | Danovi | H04R 9/063 |
| 2004/0170297 | A1 * | 9/2004 | Hikichi | H04R 9/06 381/430 |
| 2007/0009133 | A1 | 1/2007 | Gerkinsmeyer | |

* cited by examiner

ACOUSTIC MEMBRANE FOR A LOUDSPEAKER AND CORRESPONDING LOUDSPEAKER

CROSS-REFERENCE TO RELATED APPLICATIONS

This application is a national stage application under 35 U.S.C. § 371 of PCT Application No. PCT/FR2016/052962, filed on Nov. 15, 2016, which claims priority to and the benefit of French Application No. 1562261 filed on Dec. 14, 2015, which are incorporated herein by reference in their entirety.

TECHNICAL FIELD

The invention belongs to the field of acoustic equipment. The invention relates to an acoustic membrane for a loudspeaker and also a loudspeaker equipped with such a membrane. More specifically, the invention targets a new acoustic membrane shape, suited in particular for implementing compact and tweeter-type loudspeakers.

PRIOR ART

In general, a loudspeaker comprises a fixed chassis and a circular acoustic membrane (or diaphragm) connected to the chassis and mechanically coupled to a winding via a cylindrical support. The winding is in particular mobile in the annular gap of a magnetic system. In practice, the magnetic system is configured for generating a magnetic field in the gap. Further, the winding is configured to receive electrical signals representative of the sound signal to be generated. Based on these received electrical signals and the magnetic field present in the gap, the winding moves in the gap thereby leading to the movement of the membrane.

In practice, each element equipping the loudspeaker is sized to allow the reproduction of sounds belonging to a preset audible frequency range. There are for example loudspeakers configured for playback of low frequencies (<150 Hz), intermediate frequencies (in the order of 150 to 2500 Hz) and high frequencies (between 200 Hz and 20 kHz); these loudspeakers are in particular known under the name of "woofer", "midrange" and "tweeter" respectively.

In particular, the membrane generally has the shape of a cone for woofers and midrange, and in the form of a rigid or flexible dome for midrange and tweeters, with a convexity turned towards the outside of the loudspeaker.

Further, in the patent application published under EP 1,618,761, the Applicant proposed a tweeter-type loudspeaker equipped with a dome membrane positioned inversely to what is generally done, meaning that the concavity of the dome is turned towards the outside of the loudspeaker in the direction of the axis of movement of the coil or support. The cylindrical support of the winding is simply attached on the convex surface at mid-height of the dome, so as to uniformly move the entire surface of the membrane.

However, this inverted dome configuration does not allow compact loudspeaker implementation, in particular in the direction of movement of the coil. In fact, in order to guarantee a maximum excursion of the coil and therefore the membrane, the depth of the chassis in which the magnetic system and the winding are housed has to be increased. Additionally, in order to displace the self-resonant frequency of the membrane outside of the audible frequency band, and in particular to push the self-resonance frequency thereof as high as possible, the membrane must necessarily be made of rigid material, in particular beryllium. Further, this solution does not guarantee a precise positioning of the coil support relative to the center of the membrane. This solution also does not offer an optimal geometric rigidity for the point of coupling with the support of the winding. A consequence of this weakness is to considerably lower the frequency of the fundamental resonance mode and therefore limit the useful bandwidth of the tweeter.

BRIEF DESCRIPTION OF THE INVENTION

In this context, the present invention therefore aims to improve the solution presented above.

In particular, the goal of the present invention is notably to propose an alternative acoustic membrane solution with which to implement a compact loudspeaker, in particular compact in the direction of movement of the coil.

The solution of the invention also aims to propose a solution which allows the use of flexible or rigid material for the membrane and also easy and precise positioning of the coil support on the membrane.

Thus the subject of the invention is a circular acoustic membrane having an upper surface and an opposite lower surface. This membrane is therefore intended to be coupled, at the lower surface thereof, to a mobile winding via a support.

According to the invention, the membrane has a concentric annular fold delimiting in the membrane a circular central portion and an annular peripheral portion, where the central portion has a concavity turned towards the upper surface of the membrane. Further, the internal edge of the fold is carried by the lower surface and comprises or forms an attachment surface intended for coupling with the support of the coil.

Thus, the acoustic membrane of the invention has a substantially M-shaped profile. More specifically, the acoustic membrane is provided with an annular fold substantially centered on the center of the membrane, and also two portions on either side of this annular fold. The portion of the membrane inside the annular fold is called the central portion and has a nonzero diameter and a concavity intended to be turned towards the outside of the loudspeaker. The portion of the membrane outside of the annular fold is called the annular portion and has a free outer edge intended to be fixed to a chassis of a loudspeaker generally via a suspension. In practice, this annular portion can also have a concavity intended to be turned towards the outside of the loudspeaker. The internal edge of the fold is in particular intended to be in contact with the support for the winding.

First, such a configuration makes precise and accurate positioning of the coil support on the membrane easier because this position is identified on the membrane by the fold thus formed.

Next, the specific positioning of the coil support on the membrane has a very favorable effect on the resonance phenomenon. In fact, conventionally, the upper part of the coil support, meaning the part in contact with the membrane, participates in the appearance of undesired deformations of the membrane which can lead to distortion of the audio signal. With the geometry of the membrane of the invention, the upper part of the coil support is constrained for avoiding an incoherent deformation of the membrane in a given audible frequency range, and therefore increasing the breakup frequency of the membrane.

Further, the barycenter of the membrane is made closer to the plane of adhesion of the suspension. With this configuration, the appearance of nonlinear oscillatory movements of the surface of the membrane is reduced and therefore so is the risk of rocking (usually designated by the name "rocking mode") of the membrane which could lead to mechanical collisions of the coil against the walls of the gap. It is then possible to attach the membrane to the loudspeaker chassis through less rigid suspensions.

In practice, the fold and also the two portions of the membrane can be obtained by forming a single sheet of material. The fold can also result from assembly of two distinct portions of identical or different materials.

Additionally, it is possible to use materials described as rigid in the domain of tweeter or midrange type loudspeakers, for example aluminum or Kevlar™ materials, which have in particular the advantage of having a high elastic modulus, in particular over 70 GPa. It is also possible to use materials described as flexible, for example paper or silk, having in particular an elastic modulus under 1 GPa. Further, it is possible to consider a central portion of rigid material and an annular portion of flexible material. Of course, the inverse is also possible: specifically an annular portion of rigid material and a central portion of flexible material.

Thus, in one variant, the central portion and the annular portion are of different materials.

In this scenario, the method can consist of forming the central portion and the annular portion separately, and then assembling the peripheral edge of the central portion directly with the internal edge of the annular portion. The assembly can result from a conventional adhering method.

The annular fold thus formed has overall an opening angle substantially less than 180°, for example between 130° and 150°.

In one embodiment, the opening angle of the fold can be an acute angle. In other words, the fold can be such that the tangent to the lower surface of the central portion at a point located on the edge of the fold and the tangent to the lower surface of the annular portion at the same point form an acute angle between them.

In another embodiment, the opening angle of the fold can be such that:

- The tangent to the lower surface of the central portion at a point located on the edge of the fold and a main axis of symmetry of the membrane form an acute angle therebetween; and
- The tangent to the lower surface of the annular portion at the same point and the main axis of symmetry form a second acute angle therebetween.

The main axis of symmetry of the membrane is in particular the radial axis of symmetry of the membrane and is generally substantially parallel to the direction of movement of the coil or to the main axis of the support.

In practice, the various dimensions of the membrane, such as for example the opening angle of the fold, the radius of curvature or the surface area of each of the central and annular portions, are in particular determined depending on the desired response curve and the material(s) constituting the membrane.

For example:

- the value of the first angle and the value of the second angle can be identical or different, and preferably between 80° and 50°;
- the ratio of the surface areas of the central portion and the annular portion can be between 0.8 and 1.6; and
- the radius of curvature of the upper surface of the central portion is preferably substantially equal to the radius of curvature of the upper surface of the annular portion.

Of course, the respective radii of curvature of the central and annular portions can be slightly different in order to optimize the two fundamental resonances of the membrane. It is for example possible to conceive of a difference in the order of 0.5 mm.

The subject of the invention is also a loudspeaker, for example tweeter-type, comprising:

- a fixed chassis;
- a magnetic circuit solidly attached to the chassis;
- an assembly mobile relative to the chassis comprising:
  - the acoustic membrane such as defined above, with concavity turned towards the outside of the loudspeaker, with the membrane attached to the chassis at the peripheral edge thereof via a suspension;
- at least one driver coil; and
- a cylindrical support bearing said coil and firmly secured to the internal edge of the annular fold of the membrane.

BRIEF DESCRIPTION OF THE DRAWINGS

Further characteristics and advantages of the invention will become apparent from the description provided below, which is for reference only and is in no way limiting, with reference to the accompanying drawings, wherein.

Please note that in these figures, the same references designate identical or analogous elements and the various structures are not to scale. Further, for reasons of clarity, only elements indispensable to the understanding of the invention are shown on these figures.

DETAILED DESCRIPTION OF THE INVENTION

Figure 1:
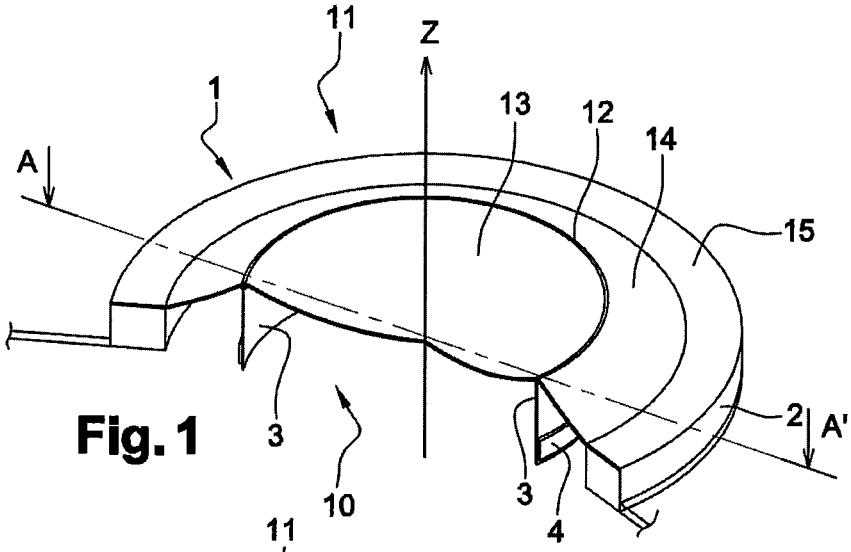
FIG. 1 is a perspective view in section of the acoustic membrane according to an embodiment of the invention.
Figure 2:
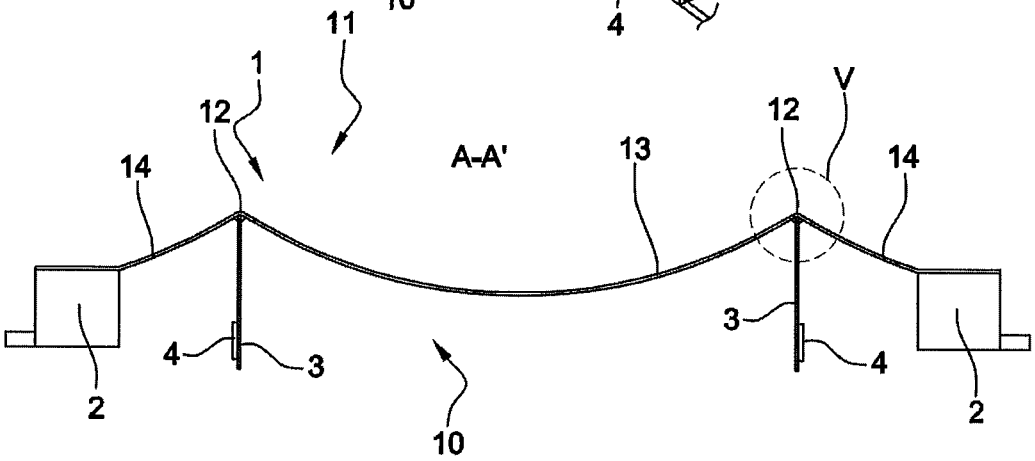
FIG. 2 is a lateral view in section along the axis AA' of the acoustic membrane from FIG. 1.
Figure 3:
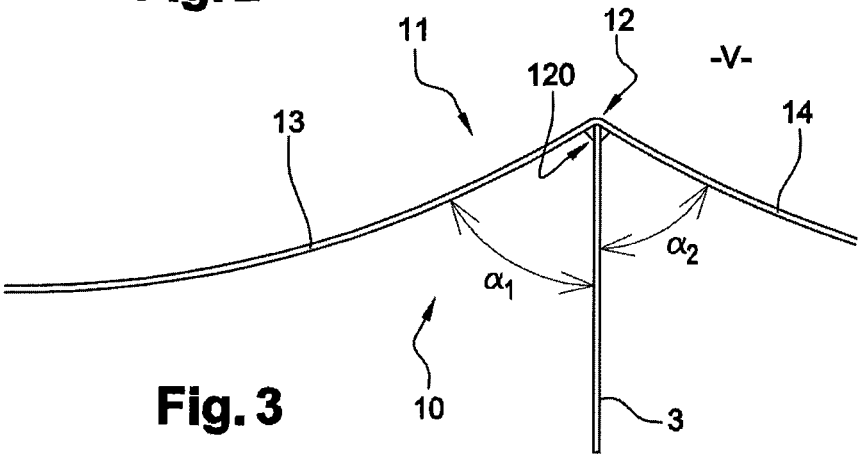
FIG. 3 is an enlargement of the region V from FIG. 2.

As can be seen, the acoustic membrane 1 shown in FIGS. 1 to 3 has a substantially M-shaped overall profile.

In particular, the acoustic membrane 1 is circular and has in particular a lower surface 10 and an opposite upper surface 11. In this membrane 1, an angular area can be seen in the form of an annular fold 12 which defines a central portion 13 and an annular portion 14 of the membrane 1. The annular fold 12 is centered on the center of the circular membrane and the internal edge 120 of the fold 12 is in particular carried by the lower surface 10 of the membrane 1. In particular, the opening angle of the fold 12 is such that the central portion 13 and the annular portion 14 are curved, with a concavity turned in a direction opposite to that of the opening angle of the fold 12. The radius of curvature of the central portion is preferably close to that of the annular portion. However, these two radii of curvature can also be different in order to adapt the fundamental resonant frequency of the central portion and that of the annular portion to the desired performance.

This membrane can be obtained by shaping a single sheet of single-layer or multilayer type material, but could also result from an assembly, for example by adhering, of two distinct preformed pieces. With the assembly, a membrane having central and annular portions of different materials, suited to the desired response curve, can be achieved. Thus, the central portion can be of a material described as rigid and the annular portion of a material described as flexible. For example, the following combinations can be considered: Aluminum-Silk, Aluminum-Mylar™, and Aluminum-Paper.

As shown in FIGS. 1 and 2, this membrane 1 is intended to be coupled to a chassis 2 at the peripheral edge 15 thereof, and to a cylindrical support 3 of driver coil 4 at the internal edge 120 of the annular fold 12. Because of the fold 12 formed in the membrane, it is easier to precisely position the support 3 on the membrane. In particular, the main radial axis of symmetry z of the membrane 1 substantially corresponds to the main axis of the cylindrical support 3 and is substantially parallel to the direction of movement of the coil in operation.

Thus, on either side of the coil support, the membrane forms acute angles relative to the coil support cylinder. In particular, the tangent to the lower surface 10 of the central portion 13 at a point located on the edge of the fold 12 and the coil support at this same point form an acute angle $\alpha_1$ therebetween. Similarly, the tangent to the lower surface 10 of the annular portion 14 at the same point and the coil support at the same point form a second acute angle $\alpha_2$ therebetween. For example, the two angles $\alpha_1$ and $\alpha_2$ can be equal or different and can be modulated depending on the desired frequency response. Generally, for one material, as the angles become more acute the more the rigidity of the membrane increases and the higher the self-resonance frequency of the membrane becomes.

In practice, the geometry of the membrane and the material(s) used have an influence on the acoustical and mechanical behavior of the membrane. Because of this, the various dimensions of the membrane can be set depending in particular on the desired response curve and on the material (s) used for the membrane.

The dimensions of the membrane according to four variants adapted in particular for implementation of a tweeter are given below as nonlimiting examples.

The following are defined for these four variants:

S1: the surface area of the central portion;

S2: the surface area of the annular portion;

R: the ratio S2/S1;

R1: the radius of curvature of the central portion;

R2: the radius of curvature of the annular portion;

$\alpha_1$: the first angle defined above; and $\alpha_2$: the second angle defined above.

In the first variant, the membrane is made from Kevlar™ and is intended to be coupled with a 20 mm diameter coil support. In this first variant, the membrane preferably has the following dimensions:

S1: 330 $mm^2$
S2: 510 $mm^2$
R: 1.55
R1: 18.9 mm
R2: 18.9 mm
$\alpha_1$: 58°
$\alpha_2$: 58°

In the second variant, the membrane is made from Kevlar™ and is intended to be coupled with a 25 mm diameter coil support. In this second variant, the membrane preferably has the following dimensions:

S1: 480 $mm^2$
S2: 650 $mm^2$
R: 1.35
R1: 19.5 mm
R2: 19 mm
$\alpha_1$: 52°
$\alpha_2$: 50°

In the third variant, the membrane is made from aluminum and is intended to be coupled with a 20 mm diameter coil support. In this third variant, the membrane preferably has the following dimensions:

S1: 330 $mm^2$
S2: 440 $mm^2$
R: 1.33
R1: 24 mm
R2: 24 mm
$\alpha_1$: 65°
$\alpha_2$: 70°

In the fourth variant, the membrane has a central portion of aluminum and an annular portion of Mylar™, and is intended to be coupled with a 25 mm diameter coil support. In this fourth variant, the membrane preferably has the following dimensions:

S1: 480 $mm^2$
S2: 600 $mm^2$
R: 1.25
R1: 22 mm
R2: 20 mm
$\alpha_1$: 60°
$\alpha_2$: 58°

Figure 4:
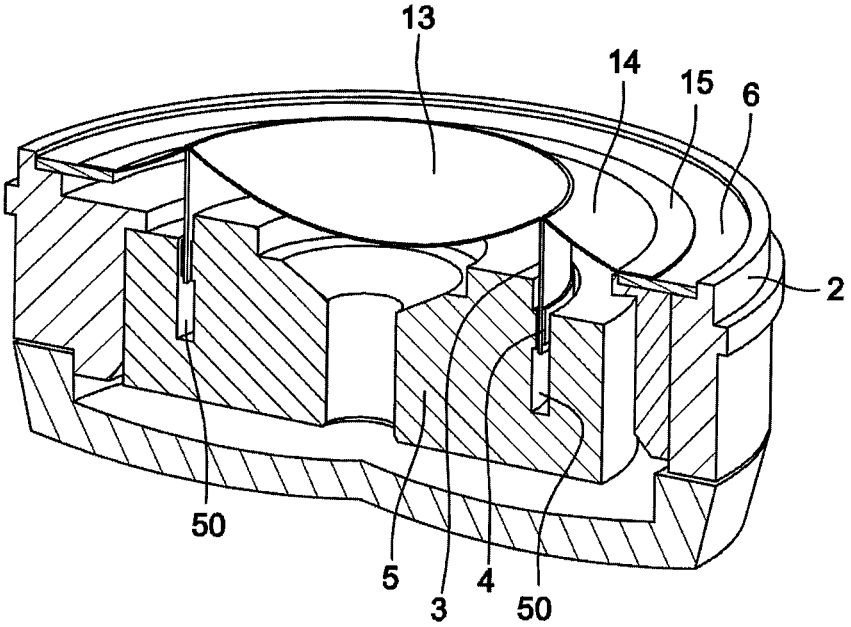
FIG. 4 is a perspective view in section of a loudspeaker equipped with an acoustic membrane according to an embodiment of the invention.

A loudspeaker equipped with an acoustic membrane described above is shown in FIG. 4. This loudspeaker is in particular a tweeter and therefore comprises the chassis 2 forming housing in which is placed a magnetic circuit 5 configured for generating a magnetic field in an annular gap 50. The acoustic membrane provided with the annular fold 12 and central and annular portions 13, 14 is also there. The peripheral edge 15 of this membrane 1 is attached to the chassis 2 via a suspension 6. In particular, the acoustic membrane is arranged such that the concavities of the central and annular portions 13, 14 are directed towards the outside of the loudspeaker. The cylindrical support 3 for the driver coil 4 is fixed to the internal edge 120 of the fold 12 of the membrane and the coil 4 is positioned in the gap 50. Note that this loudspeaker can be relatively compact in so far as it is not necessary to have a very deep housing for providing an optimal excursion of the coil.

Because of the specific geometry of the invention, a membrane with better acoustic performance than existing membranes can be proposed. In particular, with the solution of the invention, it is possible to:

implement a membrane with different flexible or rigid materials;

precisely position the coil support on the membrane;

increase the value of the mechanical breakup frequency of the membrane, in particular beyond high audible frequencies;

limit the effects of rocking of the membrane; and implement a more compact loudspeaker.

The invention claimed is:

1. A circular acoustic membrane having an upper surface and an opposite lower surface, said membrane being intended to be coupled at the lower surface thereof, to a mobile winding via a support, the membrane having a concentric annular fold delimiting in the membrane, a circular central portion and an annular peripheral portion;

the central portion having a concavity turned towards the upper surface; and an internal edge of the fold being carried by the lower surface and comprising an attachment surface intended for the coupling of said support of the mobile winding, wherein a tangent to the lower surface of the central portion at a point located on the edge of the fold and a main axis of symmetry of the membrane form a first acute angle; and a tangent to the lower surface of the annular portion at the same point and the main axis of symmetry form a second acute angle.

2. The acoustic membrane according to claim 1, wherein the central portion and the annular portion are of different materials.

3. The acoustic membrane according to claim 2, wherein the fold can be such that the tangent to the lower surface of the central portion at a point located on the edge of the fold and the tangent to the lower surface of the annular portion at the same point form an acute angle between them.

4. The acoustic membrane according to claim 2, wherein the ratio of the surface areas of the central portion and the annular portion is between 0.8 and 1.6.

5. The acoustic membrane according to claim 2, wherein the radius of curvature of the central portion is equal to the radius of curvature of the annular portion.

6. The acoustic membrane according to claim 1, wherein: the fold can be such that the tangent to the lower surface of the central portion at a point located on the edge of the fold and the tangent to the lower surface of the annular portion at the same point form an acute angle between them.

7. The acoustic membrane according to claim 6, wherein the ratio of the surface areas of the central portion and the annular portion is between 0.8 and 1.6.

8. The acoustic membrane according to claim 6, wherein the radius of curvature of the central portion is equal to the radius of curvature of the annular portion.

9. The acoustic membrane according to claim 1 wherein the ratio of the surface areas of the central portion and the annular portion is between 0.8 and 1.6.

10. The acoustic membrane according to claim 9, wherein the radius of curvature of the central portion is equal to the radius of curvature of the annular portion.

11. The acoustic membrane according to claim 1, wherein the radius of curvature of the central portion is equal to the radius of curvature of the annular portion.

12. A loudspeaker comprising:

a fixed chassis;

a magnetic circuit solidly attached to the chassis;

an assembly mobile relative to the chassis comprising:

circular acoustic membrane having an upper surface and an opposite lower surface, said membrane being intended to be coupled at the lower surface thereof, to a mobile winding via a support, the membrane having a concentric annular fold delimiting in the membrane, a circular central portion and an annular peripheral portion;

the central portion having a concavity turned towards an outside of the loudspeaker; and an internal edge of the fold being carried by the lower surface and comprising an attachment surface intended for the coupling of said support of the mobile winding, wherein a tangent to the lower surface of the central portion at a point located on the edge of the fold and a main axis of symmetry of the membrane form a first acute angle; and a tangent to the lower surface of the annular portion at the same point and the main axis of symmetry form a second acute angle;

a mobile winding;

a cylindrical support bearing said mobile winding and firmly secured to the internal edge of the annular fold of the membrane.

13. The loudspeaker according to claim 12, wherein the central portion and the annular portion of the acoustic membrane are of different materials.

14. The loudspeaker according to claim 12 wherein the fold can be such that the tangent to the lower surface of the central portion at a point located on the edge of the fold and the tangent to the lower surface of the annular portion at the same point form an acute angle between them.

15. The loudspeaker according to claim 12, wherein the ratio of the surface areas of the central portion and the annular portion of the acoustic membrane is between 0.8 and 1.6.

16. The loudspeaker according to claim 12, wherein the radius of curvature of the central portion is substantially equal to the radius of curvature of the annular portion.

* * * * *